US006562287B1

(12) United States Patent
Koester

(10) Patent No.: US 6,562,287 B1
(45) Date of Patent: May 13, 2003

(54) BLASTING LANCE WITH A GAS/LIQUID MIXING CHAMBER AND A METHOD FOR THE EXPANSION COOLING THEREOF

(75) Inventor: Volkwin Koester, Kehl-Bodersweier (DE)

(73) Assignee: Techint Compagnia Tecnica Internazionale S.p.A., Milan (IT)

( * ) Notice: Subject to any disclaimer, the term of this patent is extended or adjusted under 35 U.S.C. 154(b) by 0 days.

(21) Appl. No.: 09/623,005

(22) PCT Filed: Feb. 26, 1999

(86) PCT No.: PCT/EP99/01255

§ 371 (c)(1),
(2), (4) Date: Aug. 24, 2000

(87) PCT Pub. No.: WO99/46412

PCT Pub. Date: Sep. 16, 1999

(30) Foreign Application Priority Data

Mar. 9, 1998 (EP) ..... 98104153

(51) Int. Cl.[7] ..... C21C 5/46
(52) U.S. Cl. ..... 266/46; 266/225
(58) Field of Search ..... 266/225, 46, 220

(56) References Cited

U.S. PATENT DOCUMENTS 3,744,780 A 7/1973 Pelezarski et al.
4,413,816 A 11/1983 Makipirtti et al.
5,350,158 A * 9/1994 Whellock ..... 266/46

FOREIGN PATENT DOCUMENTS

| | | |
|---|---|---|
| EP | 0340207 | 11/1989 |
| WO | 8001000 | 5/1980 |
| WO | 9207965 | 5/1992 |

* cited by examiner

*Primary Examiner*—Scott Kastler
(74) *Attorney, Agent, or Firm*—Hedman & Costigan, P.C.

(57) ABSTRACT

The invention relates to a method for cooling a lance provided for converting a medium into a molten mass and/or for measuring the properties of the molten mass. A gas/liquid mixture is fed as a cooling medium into a cooling circuit which is closed up to the lance end (2) situated on the melting side. The invention provides that the gas/liquid mixture or the components thereof is/are fed and permitted to expand under pressure up to the area of the lance end (2) situated on the melting side. The invention also relates to a lance which has a mixing chamber (5, 6) connected to the cooling circuit The mixing chamber has the connections (3, 7) for a gas and liquid supply which is designed to produce the gas/liquid mixture, whereby the mixing chamber (5, 6) is connected via a pressure line (10) to at least one two-component nozzle (11) arranged in the area of the lance end (2) which is situated on the melting side.

10 Claims, 2 Drawing Sheets

2
A
A
12
13
11
14
15
16
10
17
8
7
6
9
5
3
4
1

14
1
11
Section A-A

Section A-A M2:1

BLASTING LANCE WITH A GAS/LIQUID MIXING CHAMBER AND A METHOD FOR THE EXPANSION COOLING THEREOF

The invention relates to a method for cooling a lance provided for introducing a medium into a melt and/or for measuring properties of the melt.

Lances for blasting media (in particular solids and/or gases) into the interior of metallurgical vessels such as furnaces or converters and as carriers of instruments for measuring properties of the melt are known. They are used, for example, for oxygen-refining a pig iron melt, for blasting in media during steel treatment (for example coal for foaming the slag) and for temperature measurement of the melt.

The end region of such a lance which faces the melt is subject to high thermal stress. From prior public use it is known to use tubular steel lances, the melt-side end of which continuously burns away in operation, with the lance having to be moved up accordingly. Moreover, cooled lances with closed water cooling circuits are known. The operation of these lances is dangerous because, in the event of a leakage in the cooling circuit, a contact of the melt with cooling water can lead to explosive reactions. If water is enclosed by the melt, the evaporation and expansion of the water which then take place can break up the melt in an explosive manner. Neither the chemical dissolution of the water nor a subsequent reaction of oxyhydrogen gas is to be excluded.

It has therefore already been suggested (DE 35 43 836 C2) to use two lances which are moved alternately into the operating position. The lance located in the operating position is cooled with a gas. Because a sufficient cooling action is not achieved in this way, the lance is moved out of the furnace after a certain operating period and recooled with water in this position which is spaced far apart from the melt. During this period the second lance continues the operation. Such an alternate operation with two lances is costly.

From WO-A-92/07965 a lance is known which has a closed cooling circuit which is supplied with a diphase mixture.

The object underlying the invention is to create a method and a lance of the type named in the introduction, which make an effective and reliable lance cooling possible.

The method in accordance with the invention is characterized in that the gas/liquid mixture or its constituents is or are conducted under pressure up to and into the region of the melt-side lance end and is or are allowed to expand there.

The melt-side lance end denotes that end of the lance which, in operation, faces the melt or optionally dips into it. It is the thermally highly stressed lance end. The cooling circuit is closed towards the melt-side lance end. In this region no exit of coolant takes place, the coolant instead being returned into a region of the lance which is spaced apart from the melt and exiting the lance at that place. The coolant circuit as a whole can either be completely closed, but an open cooling circuit can also be used, where the heated cooling medium, exiting the lance and spaced apart from the melt-side end, is not reused.

The gas content of the mixture used in accordance with the invention is preferably air or an inert gas (for example nitrogen or argon), the liquid content preferably water.

The gas/liquid mixture is conducted in accordance with the invention under pressure up to and into the region of the melt-side lance end. The term "region of the melt-side lance end" denotes a region lying in the vicinity of the appropriate lance end, which region is already thermally highly stressed in operation. The pair of terms "conducting under pressure up to and into the region of this end and the subsequent allowing of expansion" is to be understood to mean that in the named region a sudden pressure drop of the gas/liquid mixture takes place. Accordingly, the realization of the invention only depends on an appropriate pressure difference, not on the absolute levels of the respective pressures. Allowing expansion (preferably by way of allowing exit from an appropriate nozzle into an area of less pressure) has the effect that the liquid phase of the mixture is broken up into fine droplets and/or evaporated. Both effects substantially increase the cooling power because, on the one hand, the evaporating requires considerable quantities of heat and, on the other hand, finely broken-up droplets as a result of their large surface can remove additional heat quickly and effectively (with evaporation). The expansion, provided in accordance with the invention, of the coolant mixture in the region of the melt-side lance end therefore effects a clear increase of the cooling power in comparison with the prior art. On the other hand, it ensures a clear increase of safety because, as a result of the expansion procedure in the region of this lance end, there is little or no liquid phase. In the event of operating disturbances, melt penetrating into this region can therefore not enclose larger quantities of water and thereby cause thermal explosions. Within the scope of the invention, the diphase mixture of gas and liquid can be produced spaced apart from the melt-side lance end and can be supplied as finished mixture under pressure to this end and allowed to expand there. It is likewise possible to conduct gas and liquid separately under pressure up to and into the region of the melt-side lance end and either to only mix them with each other shortly before the expansion procedure or, on the other hand, to allow them to expand by way of separate nozzles which are arranged in such a way that the gas/liquid mixture is produced in situ during the expansion procedure. For example, separate nozzles can be arranged in such a way that exiting liquid is drawn off by the expanding gas and is broken up to form a fine aerosol.

The method in accordance with the invention requires considerably smaller quantities of liquid for cooling than the water cooling known in the prior art. The gas/liquid flow is adjusted in such a way that the liquid content in the region of the thermally particularly stressed melt-side lance end evaporates for the most part or completely as a result of the expansion. This has two advantages. Firstly, in this way for cooling, not only is the thermal capacity of the liquid (of the water) used, but also the substantially greater evaporation heat for the phase transition liquid-vapour, and even with relatively small liquid flows a high cooling power is obtained. If, in the event of operating disturbances, in the region of the melt-side end there results a leakage in the coolant line, the large surface of the gas/liquid mixture supplied as aerosol has the effect that in any case there results a very rapid evaporation of the liquid content, even before the melt can enclose drops of liquid.

The liquid portion of the cooling medium used in accordance with the invention is usually water. If operating conditions are chosen where the water content in the region of the melt-side lance part evaporates for the most part or completely, the cooling circuit is preferably supplied with demineralized water in order to avoid calcareous deposits in the corresponding region of the cooling area. If demineralized water is not available and if the cooling circuit must be supplied with usual tap water or untreated water, the gas/liquid flow is preferably adjusted in such a way that a smaller portion of the water evaporates in the region of the melt-side lance end, the rest being retained as finely distributed aerosol. Unwanted calcareous deposits are in this way largely avoided.

The flow speed of the diphase mixture, which is high as a result of the expansion procedure, does not entrain evaporated water, with the result that no stationary water can collect in the region of the lance tip, which water could lead to a danger of explosion in the event of a melt penetration.

The gas/liquid mixture can be produced outside the lance and supplied to the lance already as a mixture. However, within the scope of the invention it is preferred that the lance has a mixing chamber connected to the cooling circuit, the mixing chamber having connections for a gas and liquid supply and being constructed for the production of a gas/liquid mixture. The mixing chamber is arranged spaced apart from the melt-side lance end. It is preferably located in the part of the lance projecting out of the furnace or converter.

The gas/liquid mixture is conducted from the mixing chamber preferably at a pressure of 2 to 6 bar, then preferably about 3 bar, through a pressure pipe towards the melt-side lance end. In the region of this end a two-component nozzle is arranged, from which the mixture expands into a cooling area arranged in the region of the lance tip. Within the scope of the invention, the term "two-component nozzle" denotes any device which allows a passage of a liquid/gas mixture and, in the process, can maintain a pressure difference between supply side and exit side in such a way that a nozzle action results, that is to say a division of the supplied mixture in the region of lower pressure lying after the nozzle. Upon exit from the nozzle, the liquid content of the mixture is broken up into fine droplets. The expanded and heated mixture is conducted away from the melt-side lance end by way of a second pipe and exits the lance again at a connection which is preferably arranged outside the converter. The pressure of the mixture after exit from the two-component nozzle or nozzles lies preferably somewhat above atmospheric pressure. If the lance is used in a dipping operation it should be greater than the counterpressure of the liquid melt surrounding the lance tip. If, as a result of operating disturbances, there results a melting of the lance tip and a penetration of melt into the cooling area, the excess pressure prevailing therein prevents the further penetration of melt and possibly slag.

Advantageously, the mixing chamber has two annular chambers which are concentric to each other and surround the lance tube, in the radial dividing wall of which annular chambers connection bores or connection openings are arranged. The term lance tube denotes the inner tube of the entire lance arrangement, which is provided for the introduction of gas and/or solids into the melt. The inner annular chamber can receive water, for example from its end face, the outer annular chamber receiving compressed air from the circumference. By way of the bores in the radial dividing wall compressed air is mixed into the water. The mixture produced is removed at the melt-side end face of the mixing chamber and carried away.

The pressure pipe for connecting mixing chambers and a two-component nozzle is preferably a closed circular pipeline which surrounds the lance tube concentrically. The return of the expanded mixture from the melt-side lance end likewise preferably takes place by way of a closed circular pipeline which can be constructed as a second closed circular pipeline which surrounds the pressure pipe concentrically.

A second embodiment of a lance in accordance with the invention has separate pressure pipes for the supply of gas, on the one hand, and liquid, on the other hand, towards the melt-side lance end. These pressure pipes can be constructed as closed circular pipelines which surround the lance tube concentrically. In the region of the melt-side lance end the pressure pipes end in nozzle arrangements, from which gas, on the one hand, and liquid, on the other hand, exit and, in the process, in situ, that is to say during the expansion procedure, mix to form a fine-particle aerosol. The suction action of the expanding gas entrains exiting liquid and divides it into fine droplets. The flow speed of the aerosol produced in situ is so high that no considerable quantities of water whatever remain in the region of the melt-side lance end. There is therefore no, or only a small, safety risk in the event of a penetration of melt. The operating pressures of this lance can lie clearly below 3 bar. The necessary excess pressure in the gas line (compressed air line) amounts to, for example, 1 to 2 bar, preferably about 1.5 bar. The liquid (water) only needs to be supplied at a low excess pressure of below 1 bar, preferably about 0.5 bar, because during the aerosol formation it is entrained by the expanding compressed air and is divided.

A preferred field of use of the invention is the treatment of, or the performance of measurements on, metallurgical melts, for example pig iron or steel melts. However, the invention is not restricted to use with metal melts, but can be used for additional melt flows of high temperature (for example glass melts).

Exemplary embodiments of the invention will be explained in the following with reference to the drawings.

Figure 1:
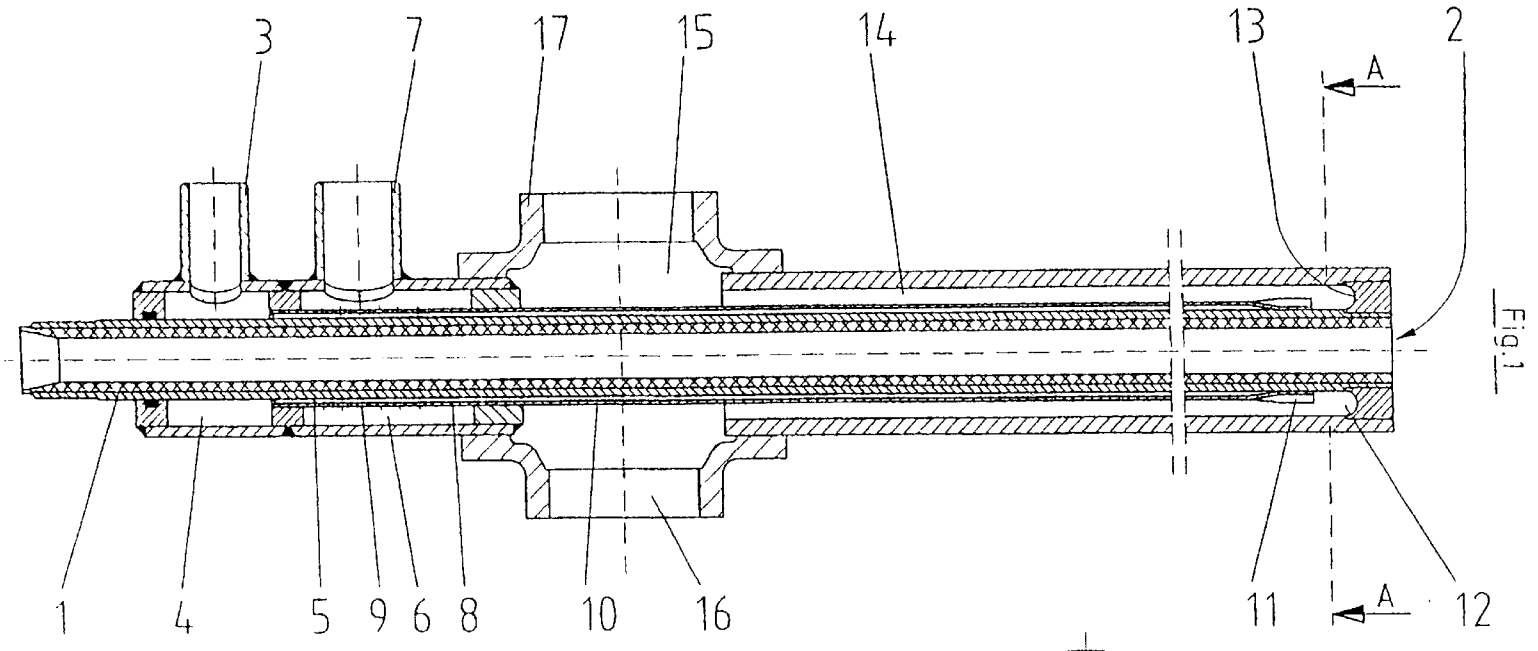
FIG. 1 shows a longitudinal section through a lance in accordance with the invention.
Figure 2:
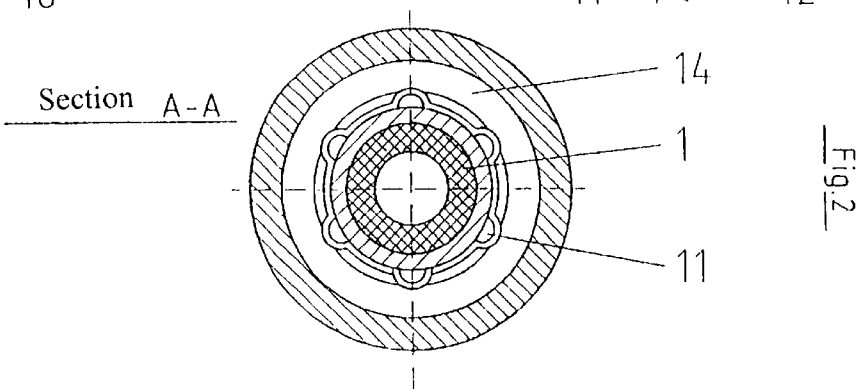
FIG. 2 shows a cross section along the plane A—A of FIG. 1.

The lance in accordance with the invention according to FIGS. 1 and 2 has an inner lance tube 1, through which solids and/or gases of the melt are supplied. The exit of these media into the melt takes place at the melt-side lance end 2. The lance tube 1 is surrounded by a cooling device which is described in more detail in the following.

By way of a connection piece 3, cooling water is supplied to an annular chamber 4 which surrounds the lance tube 1. The end faces of the annular chamber 4 and of the inner chamber 5 of the axially connecting mixing chamber are connected to each other, with the result that this inner annular chamber 5 is supplied with water from the annular chamber 4. The inner annular chamber 5 is surrounded by an outer annular chamber 6 which is supplied with compressed air by way of a connection piece 7. The two annular chambers 5, 6 together form the mixing chamber. The radial dividing wall 8 between the annular chambers 5 and 6 has connection bores indicated at 9. Compressed air and water mix with each other and the mixture is conducted through the closed circular pipeline (pressure pipe) 10, connecting axially into the inner annular chamber 5, towards the melt-side lance end. The pressure of the mixture in the pressure pipe 10 amounts to about 3 bar.

The closed circular pipeline 10 is formed in the region of the melt-side end 2 of the lance into six two-component nozzles 11 distributed evenly over the lance circumference. The water/air mixture expands upon exit from the two-component nozzles into the annular cooling area 12. The water is broken up into very fine droplets by this expansion procedure. The large surface of the water supplied favours a rapid heat absorption and therefore a high cooling power. The forming of the closed circular pipeline 10 into six two-component nozzles 11 allows operation of the lance with tap water or process water as a constituent of the cooling medium. The inside diameter of the two-component nozzles 11 makes the passage of impurities and particles possible, the latter possibly being contained in the process water. If the lance is to be operated exclusively with demineralized water, the closed circular pipeline 10 can be narrowed in the region of the cooling chamber of the cooling area 12 to form an annular gap with an inside diameter of about 0.5 mm, with the annular gap surrounding the lance tube 1 in a rotationally symmetrical manner. This annular gap forms a single two-component nozzle. The forming of several discrete two-component nozzles 11 is not necessary in this case.

At the opposite (melt-side) end face of the cooling chamber 12 the mixture exiting from the two-component nozzles 11 meets a curved cooling surface 13, by way of which its direction of movement is deflected and it is supplied to the coolant removal line constructed as second closed circular pipeline 14. The water content of the mixture supplied evaporates in the cooling chamber 12 preferably completely. In particular operating conditions, if unusually high temperatures result in the cooling chamber 12, the cooling action can possibly be supported by the greatly endothermic division of a portion of the water into molecular hydrogen and oxygen.

If, in the event of operating disturbances, the lance burns away in the region of the melt-side end 2 and the cooling chamber 12 opens towards the melt, as a result of the use of the fine aerosol as cooling medium there is practically no danger that water which is still liquid will be enclosed by the melt and will subsequently evaporate in an explosive manner. In the cooling area 12 an excess pressure is preferably set, which, during dipping operation of the lance, is sufficient in order to force back molten metal or slag which is possibly penetrating into the cooling chamber 12 and in order to prevent a further penetration.

The cooling medium flowing back through the closed circular pipeline 14 is removed from the lance by way of an annular chamber 15 and a connection piece 16. It can either be discarded (open cooling circuit) or, on the other hand, returned anew into the cooling circuit.

The annular chamber 15 has a second connection 17 which is connected to a safety pressure-control valve, not shown in the drawing.

Apart from being used to introduce media into the melt, the lance can also be used to measure properties of the melt. For this purpose, measuring instruments can be arranged in the region of the melt-side end 2, the measuring instruments not being shown in the drawing. For example, the temperature of the melt can be measured by a radiation pyrometer. With a steel melt, a multi-element analysis can be carried out, for example by means of laser-induced emission spectroscopy. In this way, for example, a steel refinement process can be carried out metrologically and ended in the desired state.

To perform such measurements the lance is guided with the measuring instrument arranged thereon into the region of the surface of the steel bath. Preferably compressed air or an inert gas such as nitrogen is blasted through the lance tube 1, which, on the one hand, keeps the lance opening clear, and, on the other hand, frees the steel bath surface of slag.

The lance in accordance with the invention is introduced through an opening in the wall or cover into the converter or furnace. The connections for the supply and removal of the cooling media and the mixing chamber are preferably located outside the converter in an appropriately cooler region.

Figure 3:
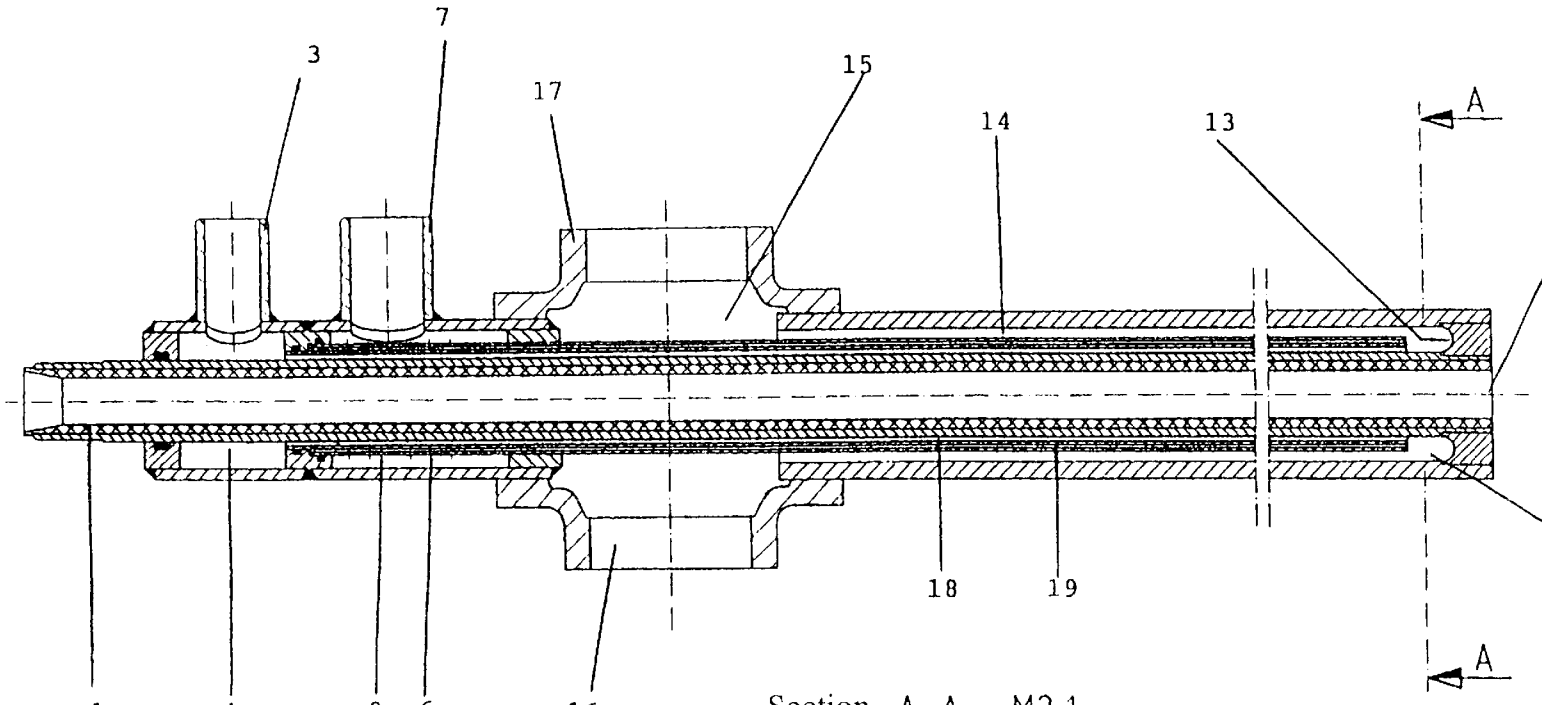
FIG. 3 shows a longitudinal section through a second embodiment of a lance in accordance with the invention.
Figure 4:
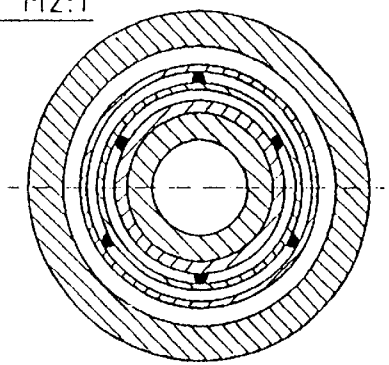
FIG. 4 shows a cross section along the plane A—A of FIG. 3.

FIGS. 3 and 4 show a second embodiment of the invention, where gas and liquid are conducted separately up to the melt-side lance end 2 and where the gas/liquid mixture is produced during the expansion procedure only in situ. Here, the same reference numerals denote functionally identical components in comparison with the embodiment according to FIGS. 1 and 2.

The substantial difference compared with the embodiment according to FIGS. 1 and 2 consists in that three closed circular pipelines, concentric to each other, are arranged around the inner lance tube 1. The inner closed circular pipeline 18 conducts cooling water to the melt-side lance end 2, being connected to the annular chamber 4 for this purpose. The middle closed circular pipeline 19 is supplied with compressed air by way of the connection 7 and the annular chamber 6 provided with connection bores 9. As in the first embodiment, the outer closed circular pipeline 14 is used to return the heated cooling medium to the annular chamber 15 and the associated connection 16.

Water and gaseous medium (compressed air) flow through the closed circular pipelines 18, 19 separately to the melt-side lance end 2. Upon the exit of the compressed air into the annular chamber 12 and the accompanying expansion, it likewise entrains exiting cooling water and divides it to form a fine aerosol. The diphase mixture used in accordance with the invention is produced in situ.

Surprisingly, the operating pressure of this embodiment can be clearly reduced compared with the lance according to FIGS. 1 and 2. Therefore, to achieve a fine-particle aerosol, which passes through the annular chamber 12 at a high flow speed and is subsequently removed, it is sufficient to supply the water in the closed circular pipeline 18 at an excess pressure of 0.5 bar and the compressed air in the closed circular pipeline 19 at an excess pressure of 1.5 bar.

What is claimed is:

1. Method for cooling a lance having a melt side end, a tube for introducing a medium into a melt and for measuring properties of the melt, a closed cooling circuit integral with said melt-side lance end (2) and tube therein, with a gas/liquid mixture conducted as a cooling medium, characterized in that the gas/liquid mixture or its constituents are conducted under pressure up to and into said closed cooling circuit integral with melt-side lance end (2) and allowed to expand there.

2. Method according to claim 1, characterized in that the gas/liquid mixture is produced in a mixing chamber (5, 6) of the lance which is arranged spaced apart from the melt-side lance end (2).

3. Method according to claim 1, characterized in that the gas/liquid mixture is conducted under a pressure substantially of 3 bar, to the melt-side lance end (2).

4. Method according to claim 1, characterized in that gas and liquid are conducted separately to the melt-side lance end (2) and are allowed to expand there, wherein during the expansion procedure a gas/liquid mixture is produced in situ.

5. Lance for carrying out the method according to claim 2, with a closed cooling circuit integral with the melt-side lance end (2), wherein a mixing chamber (5,6) is arranged which is spaced apart from the melt-side lance end (2) and connected to the cooling circuit, the mixing chamber having connections (3, 7) for a gas and liquid supply and being constructed for producing a gas/liquid mixture, wherein the mixing chamber (5, 6) is connected by way of a pressure pipe 10 to at least one two-component nozzle (11) arranged in the region of the melt-side end (2) of the lance.

6. Lance according to claim 5, wherein the mixing chamber (5, 6) has two annular chambers (5, 6) which are concentric to each other and surround said lance tube, with connection bores (9) being arranged in the radial dividing wall (8) of said annular chambers.

7. Lance according to claim 6, characterized in that the pressure pipe is a closed circular pipeline (10) which surrounds the lance tube (1) concentrically.

8. Lance according to claim 7, characterized in that, to return the expanded gas/liquid mixture from the melt-side lance end (2) to the outlet (16) of the mixture out of the lance, a second closed circular pipeline (14) is provided, which surrounds the pressure pipe (10) concentrically.

9. Lance for carrying out the method according to claim 4, with a cooling circuit closed towards the melt-side lance end (2), characterized by two pressure pipes (18, 19) connected to connections (3, 7) for a gas and liquid supply, the pressure pipes being constructed for the separate supply of gas, on the one hand, and liquid, on the other hand, towards the melt-side lance end (2) and ending in the region of the melt-side lance end (2) in nozzle arrangements, by way of which a gas/liquid mixture is produced in situ.

10. Lance according to claim 9, characterized in that the pressure pipes are closed circular pipelines (18, 19) which surround the lance tube (1) concentrically.

* * * * *